US008322848B2

(12) United States Patent
Gilfix

(10) Patent No.: US 8,322,848 B2
(45) Date of Patent: Dec. 4, 2012

(54) METHOD FOR GENERATING DOCUMENTS HAVING STORED ELECTROSTATIC PATTERN INFORMATION

(75) Inventor: Michael Gilfix, Austin, TX (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 13/451,099

(22) Filed: Apr. 19, 2012

(65) Prior Publication Data

US 2012/0206773 A1 Aug. 16, 2012

Related U.S. Application Data

(62) Division of application No. 12/630,613, filed on Dec. 3, 2009, now Pat. No. 8,199,174.

(51) Int. Cl.
*B41J 2/01* (2006.01)
*B41J 2/00* (2006.01)

(52) U.S. Cl. ..... 347/107; 347/101; 347/150

(58) Field of Classification Search ..... 347/150, 347/101, 107
See application file for complete search history.

(56) References Cited

U.S. PATENT DOCUMENTS

| | | | |
|---|---|---|---|
| 3,245,697 | A | 4/1966 | Nugent |
| 3,839,071 | A | 10/1974 | Borelli et al. |
| 5,385,803 | A | 1/1995 | Duff et al. |
| 5,389,945 | A | 2/1995 | Sheridon |
| 5,497,179 | A | 3/1996 | Aono et al. |
| 5,667,924 | A | 9/1997 | Ziolo |
| 5,903,340 | A | 5/1999 | Lawandy et al. |
| 5,903,804 | A | 5/1999 | Kirkpatrick et al. |
| 5,935,755 | A | 8/1999 | Kazmaier et al. |
| 5,983,065 | A | 11/1999 | Folkins et al. |
| 6,001,516 | A | 12/1999 | Gasper |
| 6,092,732 | A | 7/2000 | Curry |
| 6,108,612 | A | 8/2000 | Vescovi et al. |

(Continued)

FOREIGN PATENT DOCUMENTS

DE 3236373 A1 4/1984

(Continued)

OTHER PUBLICATIONS

Office Action in U.S. Appl. No. 11/103,785 mailed May 13, 2009.

(Continued)

*Primary Examiner* — Stephen Meier
*Assistant Examiner* — Sarah Al Hashimi
(74) *Attorney, Agent, or Firm* — Mitch Harris, Atty at Law, LLC; Andrew M. Harris; David A. Mims

(57) ABSTRACT

A method for generating documents having stored electrostatic pattern information provides security with respect to the authenticity of documents. A liquid medium including a plurality of electrostatic monopoles is applied to the surface of a document, which embeds a permanent electrostatic pattern in the document. The pattern is then readable by an electrostatic scanner. The monopoles may be associated with differing colors, including black and white, may be transparent or have a neutral color. The patterns may embed data, certificates or shapes. The monopoles may provide a watermark or visible image. The apparatus may be a pen or printer, and may include multiple selectable vessels containing ink and/or electrostatic liquid medium of one or both charge states. Visible features of the document can be compared with the detected pattern, or the pattern may be compared to a database or decrypted with a key.

8 Claims, 4 Drawing Sheets

U.S. PATENT DOCUMENTS

| | | | | |
|---|---|---|---|---|
| 6,176,911 | B1 | 1/2001 | Schwarz | |
| 6,530,602 | B1 | 3/2003 | Stenzel et al. | |
| 6,607,267 | B2 | 8/2003 | Testardi et al. | |
| 6,647,649 | B2 | 11/2003 | Hunt et al. | |
| 6,786,954 | B1 | 9/2004 | Lee et al. | |
| 6,842,165 | B2 | 1/2005 | Inoue | |
| 6,847,347 | B1 | 1/2005 | Kazmaier et al. | |
| 6,987,868 | B1 | 1/2006 | Atarashi et al. | |
| 7,056,861 | B2 | 6/2006 | Bossert | |
| 7,832,841 | B2 * | 11/2010 | Moriyama et al. | 347/55 |
| 7,892,721 | B2 * | 2/2011 | Cioc et al. | 430/290 |
| 2002/0150829 | A1 * | 10/2002 | Zhao et al. | 430/102 |
| 2003/0002132 | A1 | 1/2003 | Foucher et al. | |
| 2003/0032700 | A1 | 2/2003 | Morrison et al. | |
| 2003/0042306 | A1 | 3/2003 | Irwin et al. | |
| 2003/0093377 | A1 | 5/2003 | Silverbrook et al. | |
| 2003/0108733 | A1 | 6/2003 | Bossert | |
| 2004/0079800 | A1 | 4/2004 | Sugino et al. | |
| 2006/0257634 | A1 | 11/2006 | Bossert | |

FOREIGN PATENT DOCUMENTS

| | | | |
|---|---|---|---|
| DE | 10228402 | A1 | 1/2004 |
| FR | 2358717 | | 2/1978 |
| JP | 2000238428 | A | 9/2000 |
| JP | 2004279732 | A | 10/2004 |
| JP | WO2004090056 | A1 | 10/2004 |
| JP | 2005060506 | A | 3/2005 |
| WO | WO/2000/036560 | | 4/1984 |
| WO | WO/2003/089250 | | 10/2003 |

OTHER PUBLICATIONS

Office Action in U.S. Appl. No. 11/103,785 mailed Nov. 20, 2009.
Notice of Allowance in U.S. Appl. No. 11/103,785 mailed Feb. 24, 2010.
Office Action in U.S. Appl. No. 12/630,613 mailed Mar. 14, 2011.
Office Action in U.S. Appl. No. 12/630,613 mailed Sep. 6, 2011.
Notice of Allowance in U.S. Appl. No. 12/630,613 mailed May 14, 2012.

* cited by examiner

METHOD FOR GENERATING DOCUMENTS HAVING STORED ELECTROSTATIC PATTERN INFORMATION

The present U.S. patent application is a Division of U.S. patent application Ser. No. 12/630,613, filed on Dec. 3, 2009 now U.S. Pat. No. 8,199,174, and claims priority thereto under 35 U.S.C. 121.

BACKGROUND OF THE INVENTION

1. Field of the Invention

The present invention relates generally to printing, scanning and document authentication technology, and in particular to a method and system for generating and authenticating documents using stored electrostatic patterns.

2. Description of Related Art

Document authentication technologies are increasingly in-demand as technologies for counterfeiting improve. Further, due to the ease of document alteration possible with today's computer document processing tools, needs for verification that a document is an unaltered original are also continuously increasing.

Existing technologies for verification include microscopic watermarks and magnetic ink patterns such as those used on currency and bank notes. A pattern that is not visible to the human eye or not visible without proper detection devices is more difficult to duplicate and/or alter. Technologies to thwart the security measures afforded by existing technologies emerge as those technologies are implemented or improved upon.

Applications of the above-mentioned security patterns are generally provided in automated printing process, but it would be useful to provide for such processes with respect to handwritten instruments. However, the technology required to implement "hidden" patterns within a document typically has a high cost that makes it prohibitive to incorporate watermarking or magnetic marking techniques within a handheld device such as a pen.

Similarly, it is typically not cost-effective to incorporate the above-described security marking techniques within a low-cost printer, as to be effective, a microscopic watermark must not be renderable by a typical photo-copier or printer and a magnetic marking process typically requires a second pass with a special device that magnetizes domains within the magnetic ink.

U.S. Pat. No. 6,530,602 discloses including machine-readable patterns of an invisible substance including binary patterns or bar codes that are printed on a document and later used to verify authenticity. The substance has physical properties that are detectable via machine, such as luminescent, magnetic, electroconductive or other mechanical properties. However, the above-referenced patent discloses only the presence or absence of an applied substance and does not contemplate application of electrostatically-detectable substance, nor a system for the production and verification of handwritten documents.

It is therefore always desirable to provide new methods and systems for document authentication. It is further desirable to provide such methods and systems having a low associated cost. It is also desirable to provide such methods and systems that can be applied to handwritten documents.

BRIEF SUMMARY OF THE INVENTION

The objective of providing new low-cost techniques for document authentication is provided in methods for generating and reading a document having embedded electrostatic pattern information.

Paper is printed or hand-written with an ink that includes a plurality of permanently charged electric monopole elements, which may be two pluralities of electric monopole elements having opposite charge. The electric monopole elements are suspended in a liquid binder that is either cured by drying, exposure to air or via another curing process. The paper can be exposed to an electrostatic field that generates a pattern in the document while the ink cures or the ink may be jetted through a print head such as those found in inkjet printers, or written by a pen having an intermittently selectable ink source or additive source that provides for addition of the monopole elements to the ink. When the ink has cured, a permanent charge pattern is available for detection at the surface of the document, which can be used to verify the authenticity of the document by reading the charge pattern with an electrostatic scanner.

The charge pattern may be tied to visible properties in that the polarity of the dipole elements may be associated with a white or black dye or dyes of differing color. Alternatively, or in combination, "invisible" ink may be printed by using dipole elements of a transparent or neutral color (e.g. white dyed dipole elements on a white background) and another non-charged ink can be used to produce the image of the document. Also, alternatively or in concert, a watermark may be printed using the charged-dipole ink or the ink may be used for the actual document image/text. The pattern of the charged-dipole ink may be a graphical pattern or may contain data such as a security certificate, information associated with the document itself or other data that is to be provided invisibly in the document.

The foregoing and other objectives, features, and advantages of the invention will be apparent from the following, more particular, description of the preferred embodiment of the invention, as illustrated in the accompanying drawings.

BRIEF DESCRIPTION OF THE SEVERAL VIEWS OF THE DRAWING

The novel features believed characteristic of the invention are set forth in the appended claims. The invention itself, however, as well as a preferred mode of use, further objectives, and advantages thereof, will best be understood by reference to the following detailed description of an illustrative embodiment when read in conjunction with the accompanying drawings, wherein like reference numerals indicate like components, and:

DETAILED DESCRIPTION OF THE INVENTION

With reference now to the figures, and in particular with reference to FIGS. 1A-1D, techniques of the present invention are illustrated by pictorial diagrams that show surfaces of documents in accordance with an embodiment of the present invention are produced and readable by systems in accordance with embodiments of the present invention. Each of the surfaces contains regions printed or written with a liquid medium containing electrostatic monopoles that are subsequently adhered in place by drying or curing of a binder in the ink within which the monopoles are suspended.

The monopoles employed in the present invention are permanently charged, generally in the form of a dielectric sphere that is commercially available for use in sub-elements of larger spheres used in electronic ink displays. U.S. Pat. No. 6,842,165 describes such displays and "electrophoretic" inks and is incorporated herein by reference. An electrophoretic ink is defined by the above-incorporated application as a visible ink containing charged particles. The present invention does not require that pigment be provided in the ink, only that the ink contain the charged particles. The above-incorporated patent application is directed toward new electronic ink displays that contain the sub-element (monopole) spheres within a larger sphere (microcapsule) and permit the sub-element spheres to move only within the larger spheres, which provide an improvement in the "electronic paper" technology described. Prior to the use of the microcapsules, electronic paper based on electrophoretic ink had poorer persistence characteristics.

In the present invention, the monopoles are used without the enclosing spheres and are permanently affixed at creation of a document, thus the persistence of the electrophoretic ink is not at issue. The document blank form is generally paper, but electrostatic patterns may also be generated on cardboard boxes, plastic, or any other surface to be printed with an image or information for which it is desirable to later authenticate the image or information. As such, it should be understood that the term "document" as used herein applies to the above-listed media and articles such as mailing labels, computer optical media labels (either direct-printed or applied), and so forth.

Figure 1A:
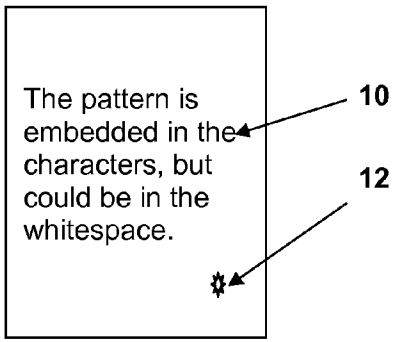
FIGS. 1A-1D are exemplary patterns as produced in a document in accordance with embodiments of the present invention.

Referring now to FIGS. 1A-1D various document surfaces as may be generated and verified by methods and systems according to embodiments of the invention are shown. FIG. 1A illustrates a document containing a printed image 10 that has electrostatic monopoles embedded in patterns within the ink forming the characters. The patterns may be made very small and may be repetitive or unique. The whitespace can also be marked with patterns, as the electrostatic ink can be made invisible or with a neutral color (generally white) matching the document background. An authentication mark 12, which may also be made visible or invisible can be formed with "electrostatic" ink and used to verify the authenticity of the document, either by pattern-matching the shape, reading binary data encoded within the mark and/or by comparing the visual features of the mark with hidden electrostatic features.

Figure 1B:
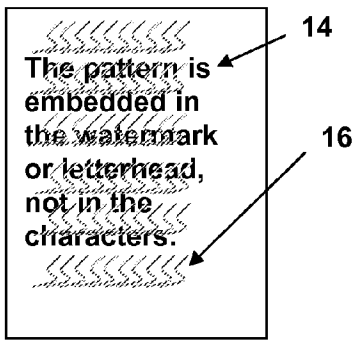

FIG. 1B illustrates a document having a watermark 16, which can also be made visible or invisible and can be provided on stock paper, serving as an electronic "letterhead" that is restricted for use to certain personnel, or may be printed at the time of adding text or image information 14 to the document. Letterheads themselves may also serve as the watermark 16 pattern, providing a visible and verifiable form to which content is added later.

Figure 1C:
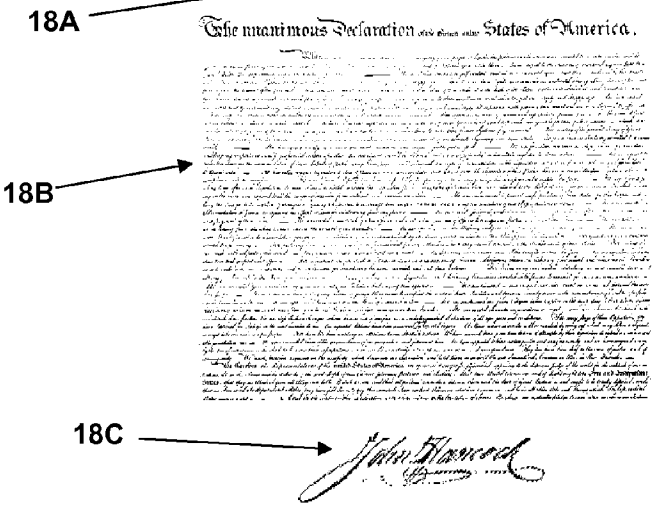

FIG. 1C illustrates the use of the invention in handwriting. Embodiment of the inventions include pens for handwriting that can write an ink containing permanent electrostatic monopoles and may have selectable ink vessels and/or tips that dispense electrostatic inks of either charge polarity and optionally a regular ink. If a regular ink is employed, the electrostatic ink(s) may be invisible. For illustration, if the author of the document in FIG. 1C selects a visible positively charged ink for heading 18A, a non-charged ink for body text 18B and a negatively charged ink for signature 18C, such a pattern can be recalled by the author to verify the authenticity of the document.

Figure 1D:
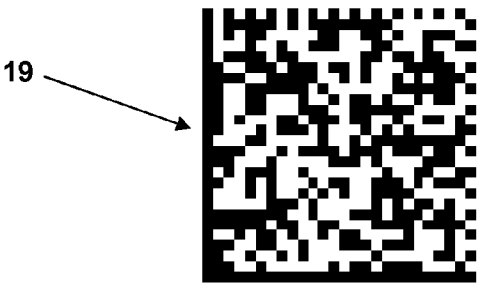

FIG. 1D illustrates a detail that may be embedded in any of FIGS. 1A or 1B, as described above or used alone in visible or invisible form to encode data. The detail is a 2-Dimensional bar code 19 as in common use in visible form for labeling. However, if a visible form of bar code 19 is used, an electrostatic code that may or may not match the visible code may be embedded in bar code 19. In any form of binary data (or other numeric symbol representation of data) that is embedded in the documents produced by a method and apparatus in accordance with embodiments of the present invention, decryption keys may be embedded in the document for decoding other data in the page or relating amongst pages of a document by decoding other data in other pages, or for verification against a database. Database verification is not limited to encryption/decryption keys, but may also include unencrypted storage of patterns that are embedded in documents or storage of encrypted certificates that can be verified by electrostatically encoded information read from the document to be authenticated.

Figure 2B:
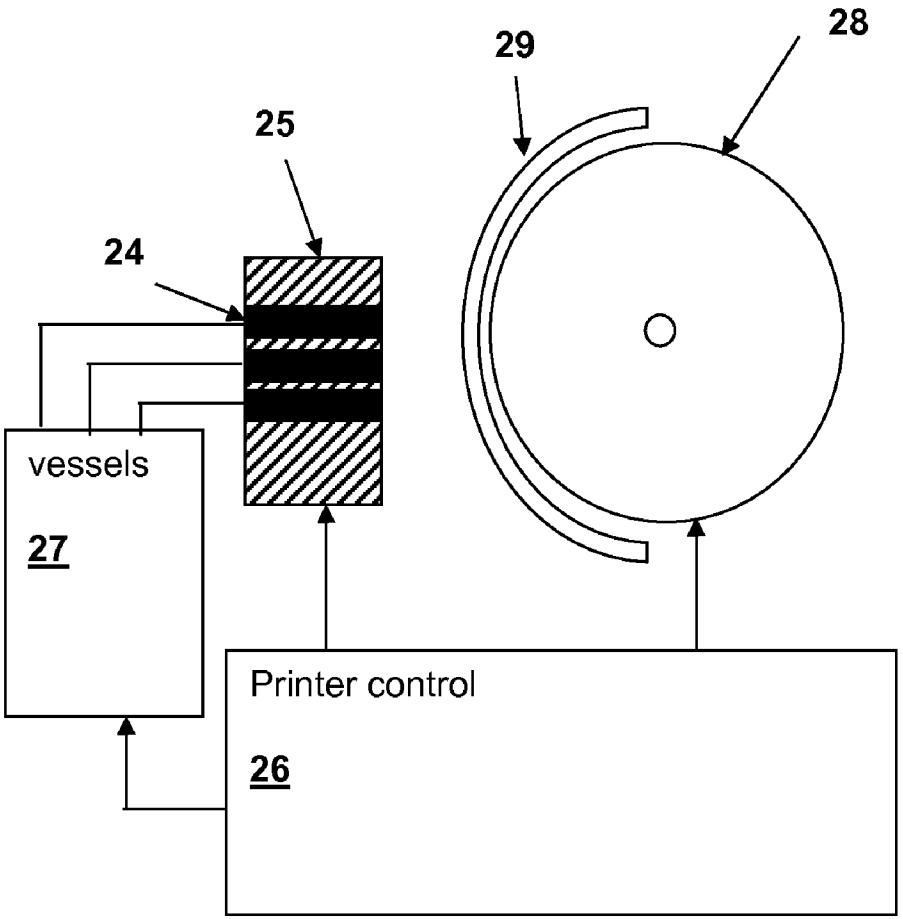
FIGS. 2A and 2B are diagrams depicting document generating devices in accordance with an embodiment of the invention.
Figure 2A:
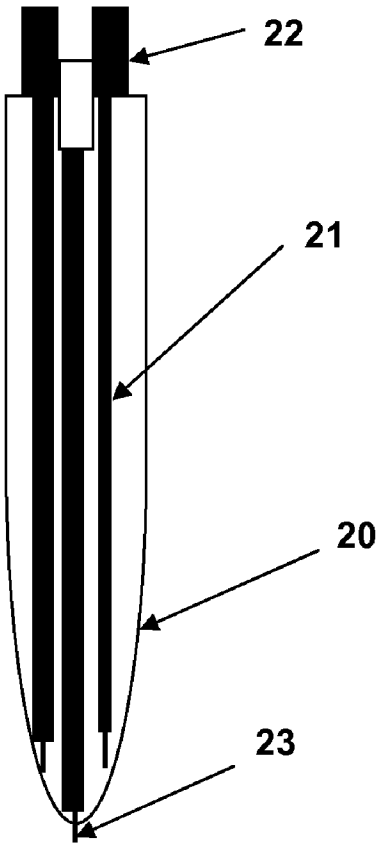

Referring now to FIG. 2A, an apparatus in accordance with an embodiment of the invention is depicted in the form of a pen 20. Within pen 20, multiple ink barrels (vessels) 21 are selected by buttons 22 to cause tip 23 to protrude for writing. Pen 20 may contain one such barrel having electrostatic ink of one polarity, or may have multiple selectable barrels with two or more of: electrostatic ink of negative polarity, electrostatic ink of positive polarity and visible non-electrostatic ink. While a single electrostatic ink barrel can provide verification either by use in concert with another writing instrument, a selectable barrel pen provides more flexibility in generating hidden authentication information, and can provide for an instrument that can write visibly with no electrostatic feature or alternatively with visible or invisible electrostatic marking.

Referring now to FIG. 2B, another apparatus in accordance with another embodiment of the present invention is shown in the form of an ink-jet printer. An ink-jet head 25 has multiple nozzles 24 coupled to one or more vessels 27, at least one of which contains an electrostatic ink containing the above-described monopoles. A printer control 26 provides for interface and operation of the printer and generally comprises a processor, memory and interface circuits. Printer control 26 is electrically coupled to a platen 28 for moving paper 29 and also for providing an electrostatic potential to platen 28. In standard electrostatic printers that print non-permanently charged ink, the electrostatic potential is typically of one polarity. However, in the present invention, selectable polarity may be employed to attract a particular polarity of ink to paper 29, and optionally repel another polarity of ink, retaining it in nozzle or directing stray ink of undesired polarity away from paper 29. Printer control 26 controls ink-jet head 25 to select the desired ink (or combination of inks) for a given pixel. Printer control 26 also may be coupled to vessels 27 to control the ink. It should be noted that platen 28 is not required to be charged, and vessels are not required to be controlled in order to print electrostatic ink, as ink jet head 25 can release ink that is permanently charged and it can be ejected under the ink's own internal (monopole repulsion) pressure. Alternatively, ink jet head can be set to a selectable polarity potential and used to accelerate the ink toward the paper and ink jet head 25 may include stages of alternating potential used to prevent directing the ink toward ink-jet head 25 itself.

In all of the above-described embodiments, it should be understood that appropriate measures may be required to insulate the ink-containing vessels from each other and from the user if the concentration of the monopoles and the volume of the ink vessels causes sufficient potential to pose a hazard or cause failure of the apparatus. During installation of the ink into a vessel, a potential may be required or sufficient pressure applied to overcome the internal repulsive forces between the monopoles.

As an alternative embodiment of the ink-jet printer described above, an ink vessel containing both polarities of monopoles may be used that reduces the external field and eases the task of charging the vessels. Selection of a particular ink can then be made by the polarity of platen 28 and/or ink-jet head 25.

Figure 3:
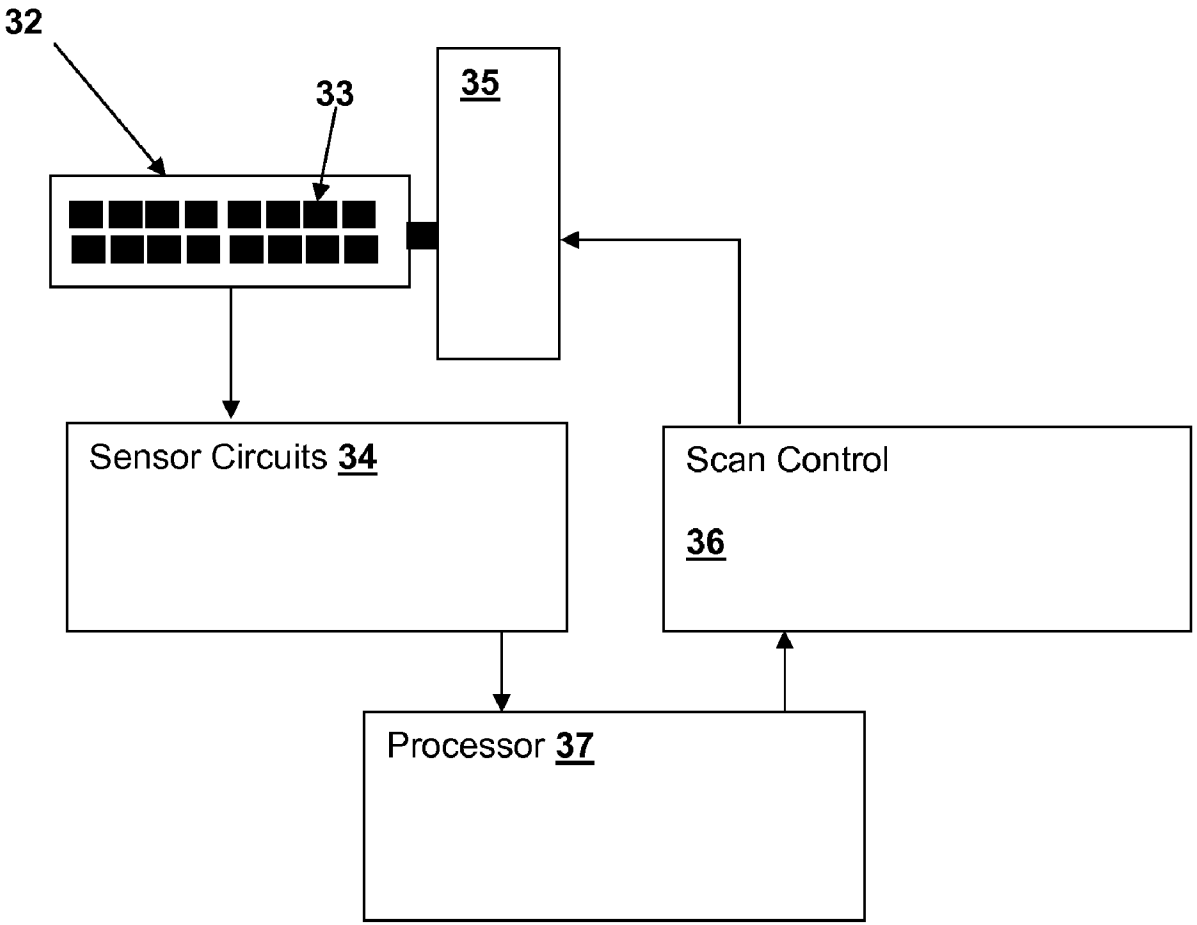
FIG. 3 is a diagram depicting a document verifier in accordance with an embodiment of the present invention.

Referring now to FIG. 3, a verification system is shown in accordance with another embodiment of the invention. A sensing head 32 contains a matrix of electrostatic sensors 33, which may be active devices, or may be metal plates. Sensors 33 are connected to sensor circuits 34 that convert the electrostatic information detected by sensor head 32 to pattern information that can be stored in memory of processor 37 and provided to external systems by an interface in processor 37. A scan control 36 is commanded by processor 37 to move mechanical scan unit 35 over a document, so that sensor 32 can detect the electrostatic pattern embedded in the document.

Figure 4:
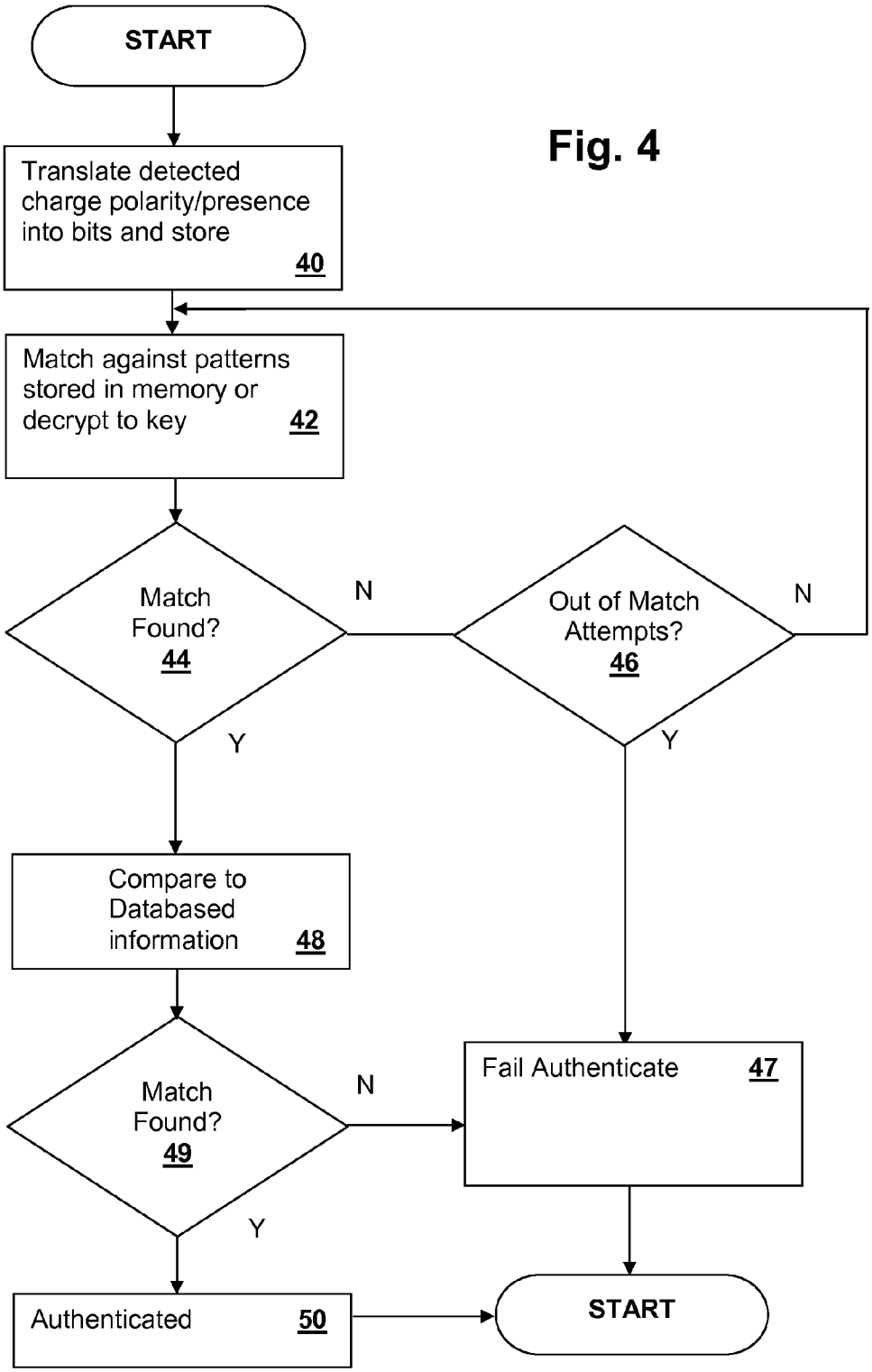
FIG. 4 is a flowchart depicting a method in accordance with an embodiment of the present invention.

Referring now to FIG. 4 an authentication method in accordance with an embodiment of the invention is shown. After the electrostatic embedded information is detected, it is translated into binary information and stored (step 40). It should be noted that either polarity or presence of electrostatic information can be detected, i.e., for a single ink the detection criteria is not the positive or negative charge state of the ink, but rather the amplitude of the electrostatic potential detected by sensors 32 over ambient.

Next, the stored information is compared to known patterns and/or decrypted using a key (step 42). If a match is found (decision 44) then the pattern is compared to stored database information (step 48) and if the information shows a match (decision 49) the document is authenticated (step 50). While no pattern match is found in decision 44, the method continues to match other patterns until the pattern database is exhausted (decision 46) and the authentication fails (step 47). If no match is found in step 49, the authentication likewise fails (step 47).

While the invention has been particularly shown and described with reference to the preferred embodiment thereof, it will be understood by those skilled in the art that the foregoing and other changes in form, and details may be made therein without departing from the spirit and scope of the invention.

What is claimed is:

1. A method for generating a document with embedded features by which said document may be authenticated, said method comprising:

first applying visible document content to a surface of said document;

second applying a liquid medium to said surface, said liquid medium including a first plurality of permanent electrostatic monopoles in suspension; and fixing said liquid medium on said surface, wherein a readable permanent electrostatic field pattern is provided at a surface of said document for subsequent verification of authenticity of said document.

2. The method of claim 1, wherein said second applying applies a liquid medium that further comprises a second plurality of electrostatic monopoles of opposite charge to a charge state of said first plurality of monopoles, wherein differentiation of said electrostatic field pattern is improved during said subsequent authentication.

3. The method of claim 1, wherein said first applying and said second applying are performed simultaneously by said second applying said liquid medium having visible properties readily distinguishable from said surface, wherein said first applying is accomplished by application of said liquid medium.

4. The method of claim 1, wherein said first applying and said second applying are accomplished by handwriting with a pen that includes said liquid medium in at least one vessel for supplying to a tip of said pen.

5. The method of claim 4, wherein said pen includes multiple vessels for supplying differing inks to one or more tips of said pen, and a mechanism for selecting among said vessels, and wherein said method further comprises selecting among at least two of:

a first liquid medium including plurality of electrostatic monopoles in suspension;

a second liquid medium including a second plurality of electrostatic monopoles in suspension, said second plurality of elestrostatic monopoles having an opposite charge from a charge state of said first plurality of electrostatic monopoles; and an ink containing no electric monopoles and having visible properties readily distinguishable from said surface.

6. The method of claim 1, wherein said applying is performed by directing said liquid medium through a nozzle at said surface.

7. The method of claim 6, further comprising selecting among at least two of:

a first liquid medium including plurality of electrostatic monopoles in suspension;

a second liquid medium including a second plurality of electrostatic monopoles in suspension, said second plurality of elestrostatic monopoles having an opposite charge from a charge state of said first plurality of electrostatic monopoles; and an ink containing no electric monopoles and having visible properties readily distinguishable from said surface.

8. The method of claim 1, wherein said second applying applies a liquid medium containing a plurality permanently charged negative and positive dipoles, and further comprising applying an electric field pattern to said surface prior to fixing said liquid medium, wherein a readable permanent electrostatic field pattern is provided at a surface of said document.

* * * * *